US006357151B1

(12) United States Patent
Yuen

(10) Patent No.: US 6,357,151 B1
(45) Date of Patent: Mar. 19, 2002

(54) ORNAMENTAL DISPLAY RECEPTACLE

(76) Inventor: Wang Sing Yuen, 11/F, Flat D, Block 2, Tai Ping Ind. Centre, 55 Ting Kok Rd., Tai Po, N.T., Hong Kong (CN)

( * ) Notice: Subject to any disclaimer, the term of this patent is extended or adjusted under 35 U.S.C. 154(b) by 0 days.

(21) Appl. No.: 09/635,572

(22) Filed: Aug. 9, 2000

Related U.S. Application Data

(60) Provisional application No. 60/173,512, filed on Dec. 29, 1999.

(51) Int. Cl.[7] ..... G09F 19/00
(52) U.S. Cl. ..... 40/406; 40/410; 40/426
(58) Field of Search ..... 40/426, 409, 410; 446/134, 136

(56) References Cited

U.S. PATENT DOCUMENTS 4,490,931 A * 1/1985 Fleemin ..... 40/409
4,757,986 A 7/1988 Hwang et al.
4,852,283 A 8/1989 Teng
5,620,353 A * 4/1997 Lai ..... 40/410
6,006,461 A * 12/1999 Snyder ..... 40/426
6,078,000 A 6/2000 Chen
6,282,820 B1 * 9/2001 White et al. ..... 40/426

* cited by examiner

*Primary Examiner*—Cassandra H. Davis
(74) *Attorney, Agent, or Firm*—Shlesinger, Arkwright & Garvey LLP

(57) ABSTRACT

This invention deals with an ornamental display receptacle which has a transparent envelope which contains a clear fluid and a particulate such as artificial snow or leaves or the like, which is suspendable in the fluid upon agitation, thus simulating falling snow, leaves or the like, and which includes a power driven agitator which will maintain the particulate in suspension so long as the motor is in the ON. The particulate will be at rest in the display receptacle when the motor driven agitator is not operating. An ornament, such as a house or an individual or the like, will be positioned in the receptacle to enhance the simulation of activity around the ornamental object.

3 Claims, 2 Drawing Sheets

ORNAMENTAL DISPLAY RECEPTACLE

CASE HISTORY

This application is based on Provisional Application No. 60/173,512, filed on Dec. 29, 1999.

INVENTION

The invention relates to ornamental devices of the nature called "snowballs" or "snowglobes" wherein a material is suspendable in a clear liquid observable through a transparent envelope and in which there is a particulate which when the fluid is agitated, will take on the appearances of snow, confetti, leaves, sand or the like falling on a scene within the envelope such as a house or trees or individuals or the like.

HISTORICAL BACKGROUND AND SUMMARY

"Snowglobes" have been known for many years. They usually include a Christmas scene or a replica of a well known scene such as a winter scene in which the White House, a covered bridge, Nativity or the like is disclosed which can be shaken by hand so that the artificial snow will be mixed in the fluid to give the appearance of snow falling, etc. These devices are readily available in retail stores and souvenir outlets. Some of the devices may include a music box. Unfortunately the ornamental devices are so constructed that the particulate material used to simulate snow or leaves or the like, will not stay in suspension for any great length of time and will eventually fall to the bottom of the device until shaken once again.

OBJECTS AND SUMMARY OF THE INVENTION

It is an object of this invention to provide an ornamental display receptacle which will maintain the particulate in suspension as long as desired without manipulating the device.

Still another object of this invention is to provide an ornamental display receptacle which has an agitator which is power driven and which can be turned OFF and ON as desired.

Another object of this invention is to provide an ornamental display receptacle which is inexpensive and easy to manufacture and which provides entertainment for extended periods of time without manipulation by an individual.

It is another object of this invention to be able to provide a suspendable particulate in a liquid display device in which the particulate can be agitated at various rates of speed to give certain effects such as a light snowfall, moderate snowfall or blizzard type conditions.

In summary this invention relates to ornamental display receptacles which contained a fluid in a particulate in the fluid which can be agitated without manual manipulation.

These and other objects of the present invention will be apparent from the following description including the drawings in which:

BRIEF DESCRIPTIONS OF THE DRAWINGS

DETAILED DESCRIPTION OF THE INVENTION

Figure 1:
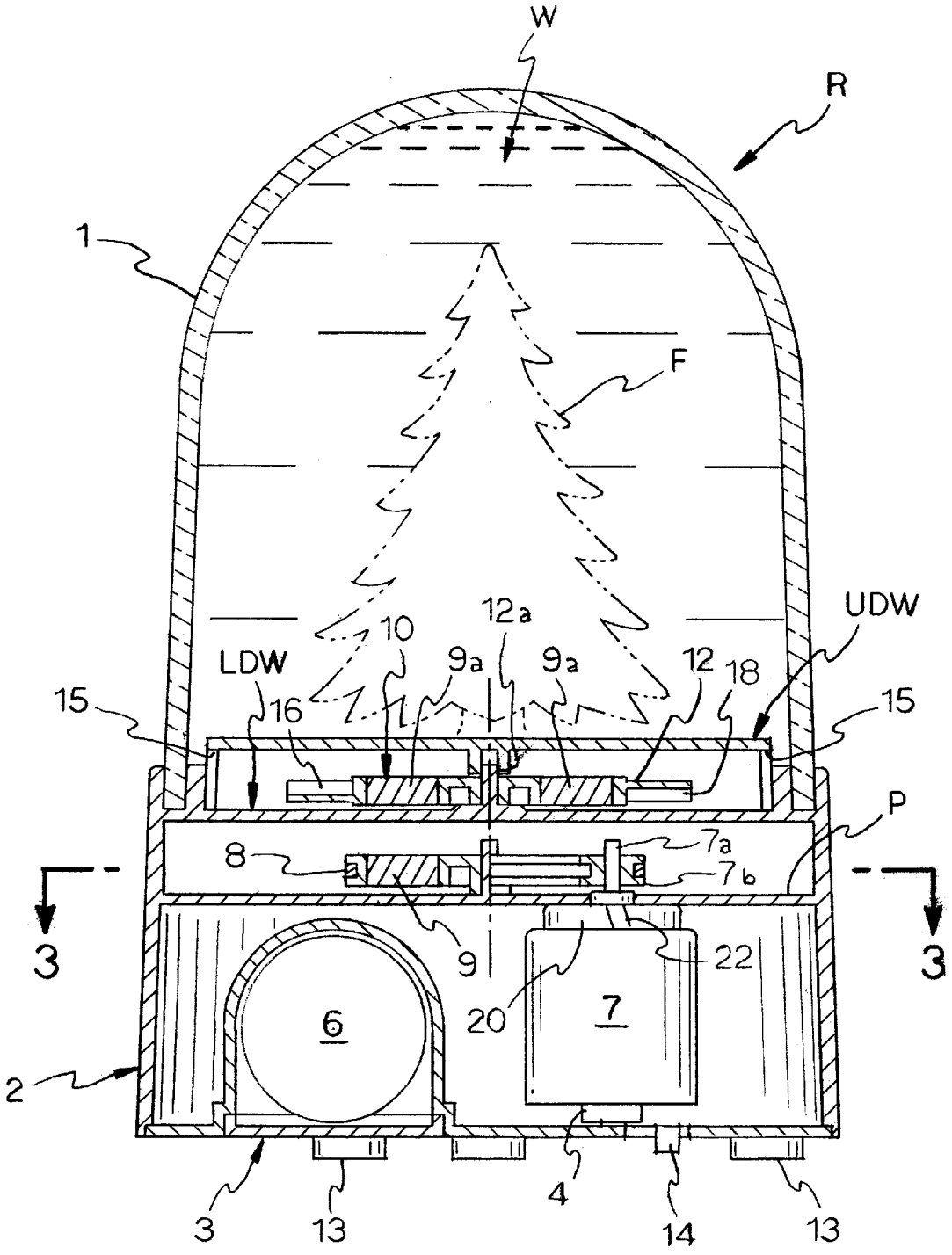
FIG. 1 is a cross sectional view of the invention.
Figure 2:
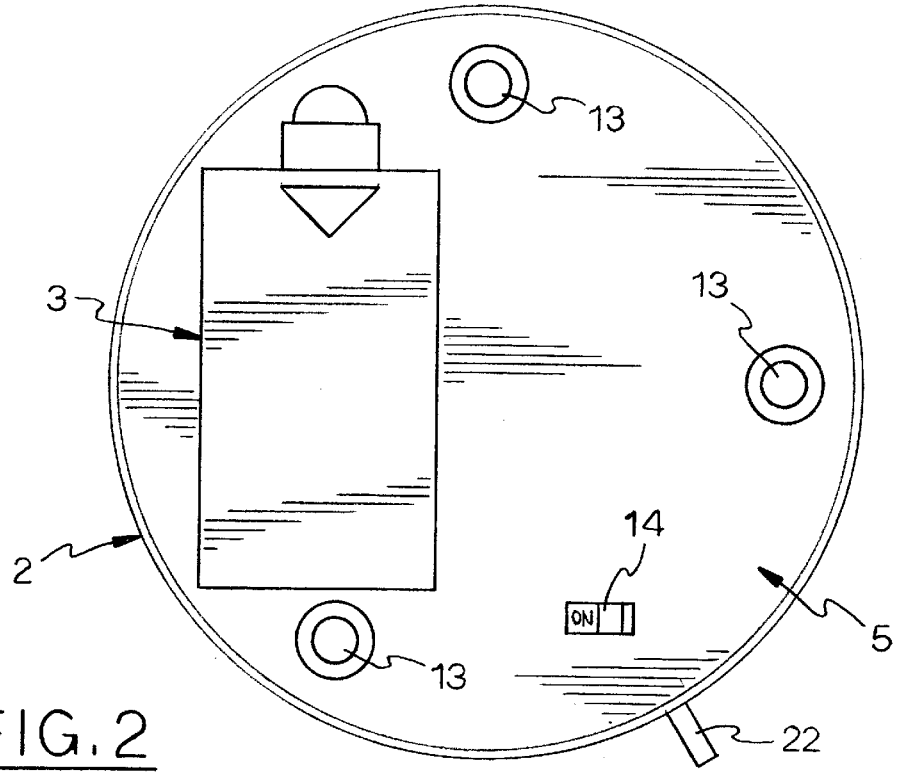
FIG. 2 is the bottom plan view of the invention.
Figure 3:
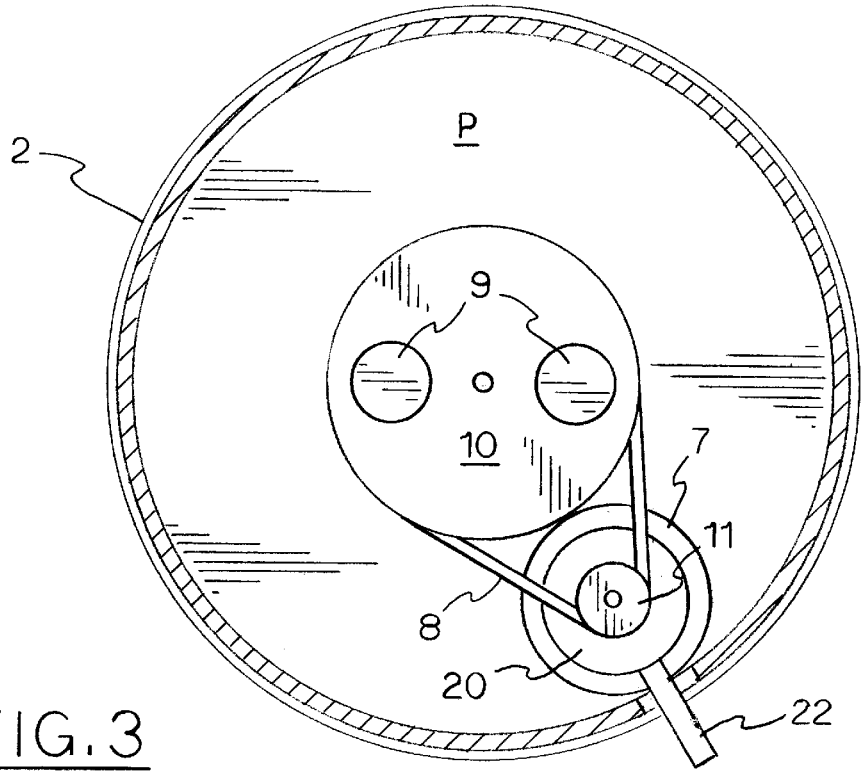
FIG. 3 is a cross sectional view showing the belt drive system.

In the drawings, the housing display receptacle R includes the transparent envelope 1 and the base 2. A battery receptacle 3 is mounted in the base 2. Motor mount 4 is in the base 2.

The base bottom is 5. Battery 6 is provided in the battery receptacle 3. The motor 7 through drive shaft 7*a* and pinion 7*b* drives a belt drive 8. Magnets 9 are positioned on a drive wheel 10. The belt drive 8 is driven by a drive wheel pinion 7*b* mounted on drive shaft 7*a*. A driven wheel 12 on shaft 12*a* has mounted therein magnets 9*a* similar to the magnets 9 that are in the drive wheel 10. The receptacle R includes a lower driven wheel support panel LDW and upper driven wheel support panel UDW which comprise a portion of base 2. A figurine or ornament F is shown in phantom in FIG. 1.

Pads 13 add support to the base 2. An ON/OFF switch 14 is provide for turning on or off the motor 7. Openings 15 allow for circulation of fluid W.

Operation

When motor 7 is turned on, the drive wheel 10 with magnets 9 will cause the driven wheel 12 to rotate due to the magnetic forces of the magnets 9 in the driven wheel 10 on the magnets 9 in the driven wheel 12. The drive wheel 12 is sealed in the transparent envelope 1 containing the clear fluid W. The driven wheel 12 may have impeller, such as blades 16 and 18, bumps, recesses or the like. Once the driven wheel 12 rotates, the fluid W in the transparent envelope 1 will start to move from the bottom and become suspended in the transparent envelope 1 passing in and out of the holes 15. The motor 7 may have a speed regulator 20 with a lever 22 to vary the speed of motor shaft 7*a* to cause the particles to circulate at different speeds. Speed reduction can be accomplished by a variable pulley, gearing or shaft friction device or the like.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. An ornamental display receptacle including:

a) a housing including a base and a transparent envelope;

b) said transparent envelope mounted on said base and sealed therefrom and having a bottom and a top;

c) an ornament mounted in said transparent envelope and visible in said transparent envelope;

d) said transparent envelope including a clear fluid substantially filling said transparent envelope;

e) a visible, agitatable particulate suspendable in said clear fluid and normally resting in said bottom of said transparent envelope in said clear fluid;

f) said housing including fluid agitating means having an on/off device for causing said particulate to be suspended in said fluid when said on/off device is on, and to rest in said bottom of said transparent envelope when said on/off device is off;

g) said fluid agitating means including a motor;

h) said motor including a first rotatable magnetic impeller in said base;

i) said transparent envelope including a perforated platform to permit said fluid to circulate when said on/off device is on;

j) a second rotatable magnetic impeller encompassed by said perforated platform;

k) said second rotatable magnetic impeller driveable by said first rotatable magnetic impeller;

l) a power source mounted in said base for said fluid agitating means;

m) said base including first and second compartments;

n) said motor being mounted in said first compartment and said first impeller being mounted in said second compartment;

o) said second impeller being sealed off from said second compartment;

p) said first and second magnetic impellers including a plurality of spaced magnets; and q) said second rotatable magnetic impeller having blades extending outwardly beyond said plurality of spaced magnets.

2. An ornamental display receptacle as in claim 1 and including:

a) a speed reduction device.

3. An ornamental display receptacle as in claim 2 and wherein:

a) said speed reduction device includes a belt drive; and b) said speed reduction device includes a lever extending outwardly from within said base for adjusting the speed of said fixed rotatable magnetic impeller.

* * * * *